US007939771B2

(12) United States Patent
Wang

(10) Patent No.: US 7,939,771 B2
(45) Date of Patent: May 10, 2011

(54) LEVER SWITCH FOR SAFE BREAKING OF A CIRCUIT OF AN EXERCISE APPARATUS

(76) Inventor: Leao Wang, Taiping (TW)

( * ) Notice: Subject to any disclaimer, the term of this patent is extended or adjusted under 35 U.S.C. 154(b) by 208 days.

(21) Appl. No.: 12/470,485

(22) Filed: May 21, 2009

(65) Prior Publication Data

US 2010/0294631 A1 Nov. 25, 2010

(51) Int. Cl.
*H01H 27/00* (2006.01)

(52) U.S. Cl. ..... 200/43.04

(58) Field of Classification Search ..... 200/553, 200/43.04, 43.08, 61.19, 61.39, 564, 335, 200/336

See application file for complete search history.

(56) References Cited

U.S. PATENT DOCUMENTS 3,906,176 A * 9/1975 Carlson ..... 200/43.04
4,115,669 A * 9/1978 Cali ..... 200/331
6,720,508 B2 * 4/2004 Moriyama et al. ..... 200/200
7,071,436 B2 * 7/2006 Coates ..... 200/341
7,335,840 B2 * 2/2008 Young et al. ..... 200/43.04
7,479,613 B2 * 1/2009 Zann et al. ..... 200/553
2005/0199478 A1 * 9/2005 Jones ..... 200/43.04
2007/0295584 A1 * 12/2007 Koo et al. ..... 200/43.04

* cited by examiner

*Primary Examiner* — Edwin A. Leon
*Assistant Examiner* — Vanessa Girardi

(57) ABSTRACT

A lever switch for safe breaking of a circuit of an exercise apparatus includes two conductive copper pieces spaced apart and stably received within a housing by means of elastic pieces. A rotatable cylinder with two journals is positioned in the area of the contact portion of the conductive copper pieces within the housing. The rotatable cylinder is provided with a contact polygon at one side thereof such that the contact portion of the rotatable cylinder is constantly clamped at the top and bottom ends of the contact polygon. A conductive wire is embedded within the contact polygon. As a result, an insertion lever may fit into the body of the rotatable cylinder for in-place-moving the rotatable cylinder such that the contact polygon is turned to be detached from the conductive wire or to be in contact with the contact portion of the conductive copper pieces for safe breaking and making of a circuit.

3 Claims, 4 Drawing Sheets

LEVER SWITCH FOR SAFE BREAKING OF A CIRCUIT OF AN EXERCISE APPARATUS

BACKGROUND OF THE INVENTION

1. Fields of the Invention

The invention relates to a lever switch for safe breaking of a circuit of an exercise apparatus, and more particularly, to lever switch that permits a safe breaking and making of a circuit by turning an insertion lever.

2. Description of the Related Art

Generally, most of the conventional power-driven exercise apparatuses are provided with an emergency cutout switch for an easy and rapid interruption of electric current in case of emergency such that the safety of the operator and people around the apparatus may be ensured.

The most common safety switch is constructed in the shape of a safety pin. The operation principle lies in that an electric connection and disconnection is established by inserting and removing the pin, respectively. In this way, an expected safety effect is achieved.

In view of the conventional design, the pin made of plastic material acts as an insulator. In brief, the power contacts are interconnected when the insulator is inserted, and they are disconnected from each other when it is removed. According to this structure, all of the power contacts are received within the housing. If the insulating pin is partially broken, the broken part will stay within the housing forever. As a result, the disconnection effect is not achieved even when the insulating pin is removed. Thus, the operation safety is no more ensured.

It is often heard that the operator is injured due to the failure of the normal disconnecting function with the conventional safety pin. In order to eliminate the above-mentioned drawbacks, the manufacturer has developed an improved structure in which an intermediate conductive body and a pin are combined in one piece. The intermediate conductive body will be simultaneously pulled out when the pin is removed. In this way, both of the power contacts within the housing won't be contacted with each other forever. As a result, the safety is further ensured.

In view of the long-term use, however, the intermediate conductive body is easily worn and deformed due to an improper storage when it is removed from the housing with the pin. Thus, the electric connection effect and the power supply stability can be seriously affected. In other words, another problem is created. Consequently, a further improvement is required.

SUMMARY OF THE INVENTION

A primary object of the invention is to provide a power cut off switch for an exercise apparatus whose intermediate conductive body is constantly received within the housing. Moreover, the corresponding elements are properly coupled and positioned such that the damage of the intermediate conductive body is avoided. In addition, the expected disconnection function is ensured.

According to the invention, a lever switch for safe breaking of a circuit of an exercise apparatus includes two conductive copper pieces spaced apart and stably received within a housing by means of elastic pieces. A rotatable cylinder with two journals is positioned in the area of the contact portion of the conductive copper pieces within the housing. The rotatable cylinder is provided with a contact polygon at one side thereof such that the contact portion of the rotatable cylinder is constantly clamped at the top and bottom ends of the contact polygon. A conductive wire is embedded within the contact polygon. As a result, an insertion lever may fit into the body of the rotatable cylinder for in-place-moving the rotatable cylinder such that the contact polygon is turned to be detached from the conductive wire or to be in contact with the contact portion of the conductive copper pieces for safe breaking and making of a circuit.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 2:
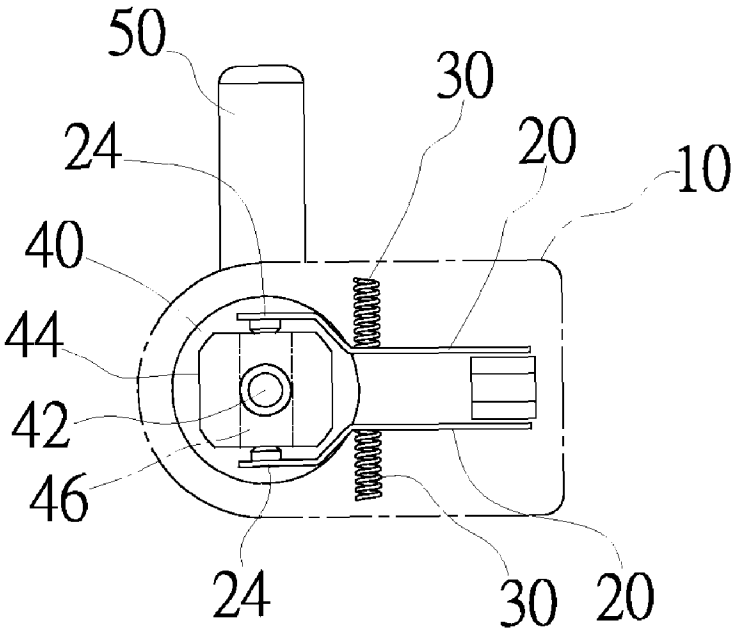
FIG. 2 is a side view of the preferred embodiment of the invention according to FIG. 1.
Figure 1:
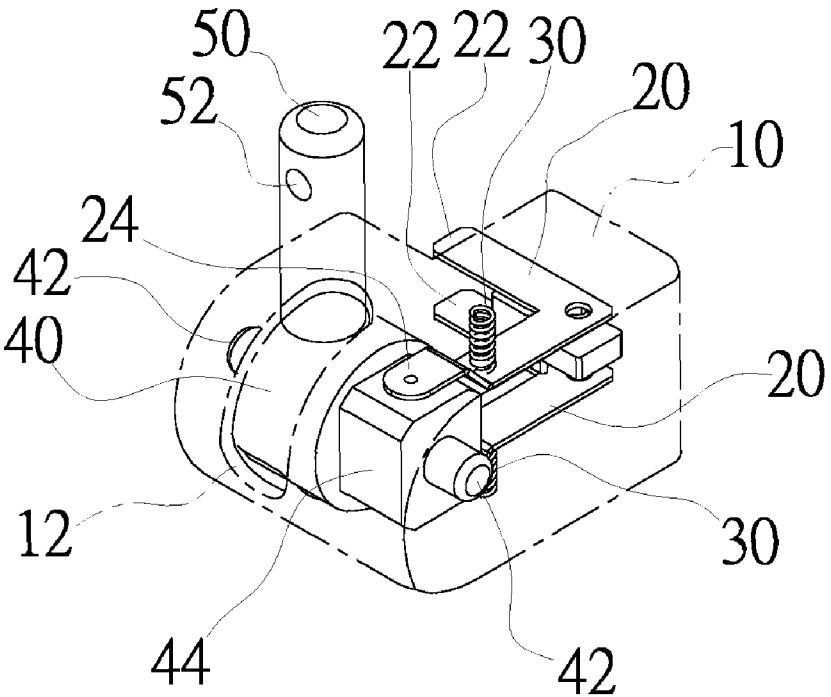
FIG. 1 is a perspective view of a preferred embodiment of the invention.
Figure 3:
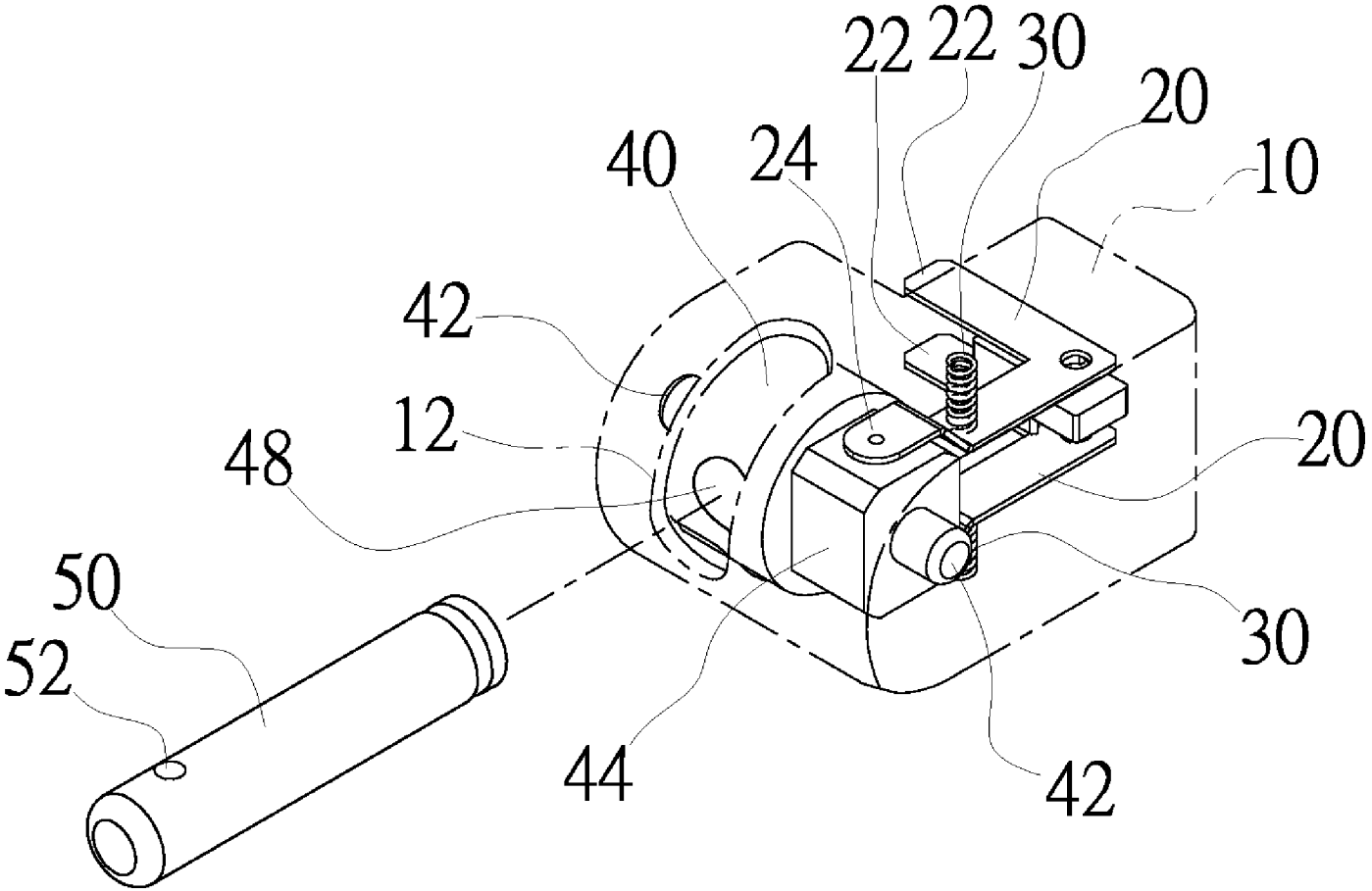
FIG. 3 is a perspective view of the preferred embodiment of the invention according to FIG. 1, wherein an insertion lever fits into an insertion hole of a rotatable cylinder.
Figure 4:
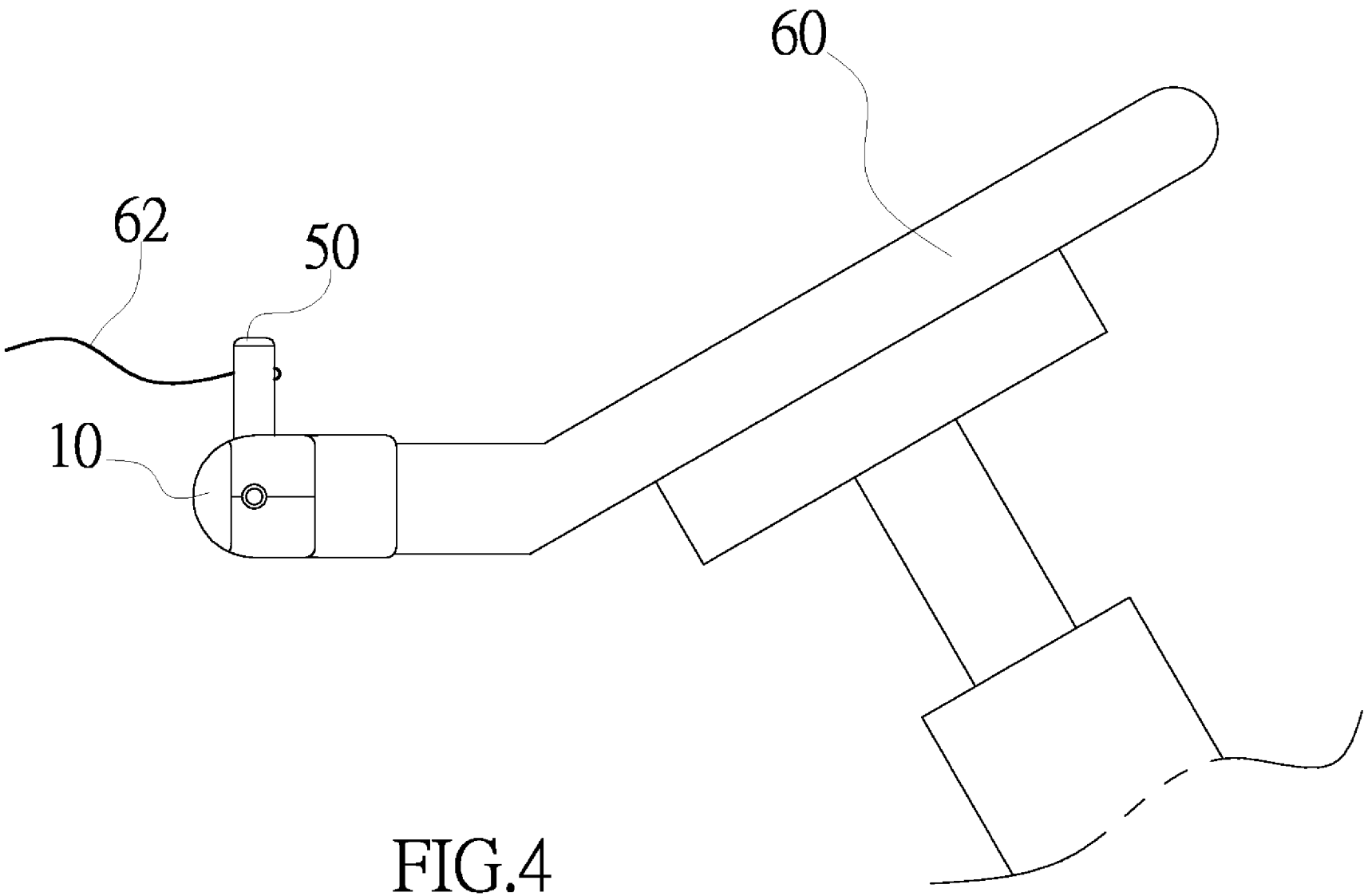
FIG. 4 is a schematic drawing of the invention applied to an electronic meter of an exercise apparatus.

The present invention will now be described in more detail hereinafter with reference to the accompanying drawings that show various embodiments of the invention.

In order to achieve a better demonstration effect, the housing 10 of the invention is marked with dash-dotted line for a better understanding of the basic arrangement of the internal components within the housing 10.

Referring to FIGS. 1 through 4, a lever switch for safe breaking of a circuit of an exercise apparatus in accordance with a preferred embodiment of the invention includes a housing 10, two conductive copper pieces 20, two elastic pieces 30, a rotatable and cylindric element 40 and an insertion lever 50.

The housing 10 includes a guide slot 12 within the movement range of the insertion lever 50.

The conductive copper pieces 20 are stably positioned within the housing 10 and spaced apart. Each of the conductive copper pieces 20 includes an insertion portion 22 at one end thereof for establishing an electric connection to a socket (not shown) of an electronic meter 60. A contact portion 24 is provided at the other end of the conductive copper piece 20.

The elastic pieces 30 are interposed between the housing 10 and the conductive copper pieces 20.

The rotatable cylinder 40 includes two journals 42 at both sides thereof. A contact polygon 44 is positioned in the area of the contact portion 24 of the corresponding conductive copper piece 20. A conductive wire 46 is embedded within the contact polygon 44. Moreover, an insertion hole 48 is formed in the rotatable and cylindric element 40. In addition, the contact portion 24 is constantly clamped at the top and bottom ends of the contact polygon 44 of the rotatable cylinder 40.

The insertion lever 50 fits into the insertion hole 48 of the rotatable cylinder 40 for moving the rotatable cylinder 40. The insertion lever 50 is detachable from the insertion hole 48 as well. A cord hole 52 is disposed at one end thereof for the passage of a cord 62.

Based on the assembly of the above-mentioned components, the insertion lever 50 is received within the insertion hole 48 of the rotatable cylinder 40 to achieve a closed circuit. In this case, the conductive wire 46 of the contact polygon 44 of the rotatable cylinder 40 is just in contact with the contact portions 24 of the conductive copper pieces 20. When the insertion lever 50 is moved by an external force, the rotatable cylinder 40 is moved as well. When the contact portions 24 of the conductive copper pieces 20 are detached from the conductive wire 46, an open circuit is created.

As depicted above, the insertion lever 50 can be removed from the insertion hole 48 of the rotatable cylinder 40. In creating the closed circuit again, the insertion lever 50 has to be inserted back into the insertion hole 48. In this way, the rotatable cylinder 40 and the contact polygon 44 are moved such that the contact portion 24 of the conductive copper pieces 20 is in contact with the conductive wire 46 again. In other words, the invention provides an additional step to create the closed circuit, thereby ensuring an increased safety in use.

Figure 6:
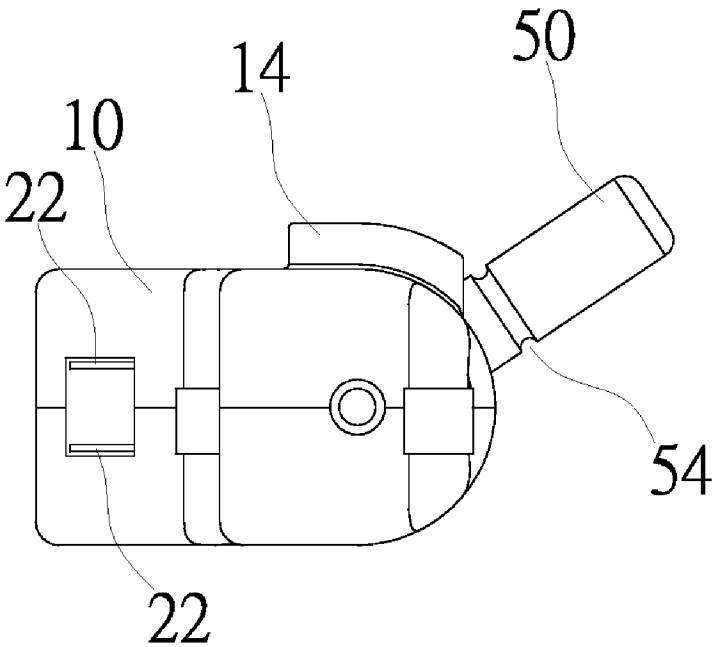
FIG. 6 is a side view of another embodiment of the invention according to FIG. 5, wherein the operation thereof is illustrated.
Figure 5:
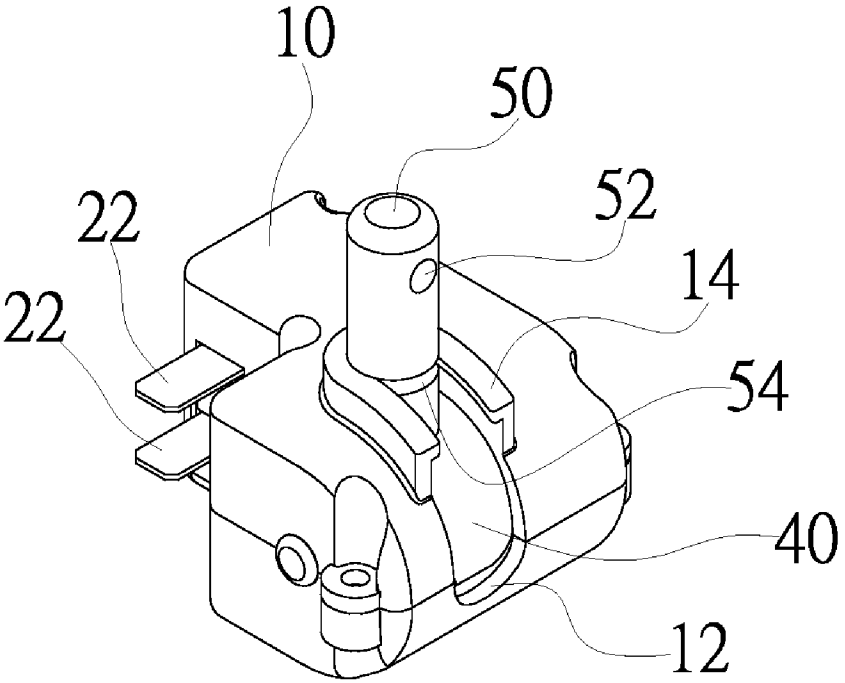
FIG. 5 is a perspective view of another embodiment of the invention.

As shown in FIGS. 5 and 6, a closed circuit is maintained. In order to prevent the insertion lever 50 from an undesired removal for a better safety in use, a position-limiting element 14 is disposed near the guide slot 12 of the housing 10. Meanwhile, the insertion lever 50 includes an annular groove 54 facing to the position-limiting element 14 such that the insertion lever 50 has to be moved to a certain place for the removal from the rotatable cylinder 40 to created an open circuit for the electronic meter 60. In other words, the insertion lever 50 must be inserted back to move the rotatable cylinder 40 to a certain place for establishing the closed circuit. As a result, a reliable operation is ensured.

Based on the above-mentioned design, the drawbacks of the conventional product in design and use can be eliminated, thereby achieving a safe operation and a prolonged service life.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A lever switch for safe breaking of a circuit of an exercise apparatus wherein two conductive copper pieces are spaced apart and stably received within a housing by means of elastic pieces, and wherein a rotatable cylinder with two journals is positioned in the area of the contact portion of the conductive copper pieces within the housing, and wherein the rotatable cylinder is provided with a contact polygon at one side thereof such that the contact portion of the rotatable cylinder is constantly clamped at the top and bottom ends of the contact polygon, and wherein a conductive wire is embedded within the contact polygon, whereby an insertion lever may fit into a body portion of the rotatable cylinder for in-place-moving the rotatable cylinder such that the contact polygon is turned to be detached from the conductive wire or to be in contact with the contact portion of the conductive copper pieces for safe breaking and making of a circuit.

2. A lever switch for safe breaking of a circuit of an exercise apparatus, comprising a housing, two conductive copper pieces, two elastic pieces, a rotatable and cylindric element and an insertion lever, wherein the housing includes a guide slot within the movement range of the insertion lever;

wherein the conductive copper pieces are stably positioned within the housing and spaced apart, and each of the conductive copper pieces includes an insertion portion at one end thereof and a contact portion at the other end thereof;

wherein the elastic pieces are interposed between the housing and the conductive copper pieces;

wherein the rotatable cylinder includes two journals at both sides thereof, and a contact polygon is positioned in the area of the contact portion of the corresponding conductive copper piece, and a conductive wire is embedded within the contact polygon, and an insertion hole is formed in the rotatable and cylindric element, and the contact portion is constantly clamped at the top and bottom ends of the contact polygon of the rotatable cylinder; and wherein the insertion lever fits into the insertion hole of the rotatable cylinder for moving the rotatable cylinder, and the insertion lever is detachable from the insertion hole as well, and a cord hole is disposed at one end thereof;

whereby the rotatable cylinder may be turned by the insertion lever such that the contact polygon of the rotatable cylinder is detached from the conductive wire or to be in contact with the contact portion of the conductive copper pieces for safe breaking and making of a circuit.

3. The lever switch for safe breaking of a circuit of an exercise apparatus as recited in claim 2, wherein a position-limiting element is disposed near the guide slot of the housing, and wherein the insertion lever includes an annular groove facing to the position-limiting element such that the insertion lever has to be moved to a certain circuit-breaking place for the removal from the rotatable cylinder.

* * * * *